United States Patent [19]

Klüpfel et al.

[11] Patent Number: 4,845,918

[45] Date of Patent: Jul. 11, 1989

[54] APPARATUS FOR PRODUCTION OF A HEAT SHRINKABLE FOIL ENCLOSED PACKAGE UNIT

[75] Inventors: Olaf Klüpfel, Ahlen; Richard Birkenfeld, Beckum, both of Fed. Rep. of Germany

[73] Assignee: Möllers Maschinenfabrik GmbH, Sudhoferweg, Fed. Rep. of Germany

[21] Appl. No.: 121,630

[22] Filed: Nov. 17, 1987

[30] Foreign Application Priority Data

Nov. 18, 1986 [DE] Fed. Rep. of Germany ..... 3639472

[51] Int. Cl.[4] ..... B65B 53/06

[52] U.S. Cl. ..... 53/170; 53/557; 53/567

[58] Field of Search ..... 53/442, 557, 170, 567

[56] References Cited

U.S. PATENT DOCUMENTS

| | | | |
|---|---|---|---|
| 3,903,673 | 9/1975 | Grasvou | 53/557 |
| 4,060,957 | 12/1977 | Birkenfeld | 53/557 X |
| 4,258,533 | 3/1981 | Aka | 53/557 X |
| 4,434,603 | 3/1984 | Beumer | 53/557 |
| 4,575,989 | 3/1986 | Hannen | 53/557 X |
| 4,724,652 | 2/1988 | Biekenfeld | 53/557 |

FOREIGN PATENT DOCUMENTS

| | | | |
|---|---|---|---|
| 2743568 | 3/1979 | Fed. Rep. of Germany | 53/442 |
| 2916298 | 10/1980 | Fed. Rep. of Germany | 53/557 |

*Primary Examiner*—John Sipos

*Attorney, Agent, or Firm*—Toren, McGeady & Associates

[57] ABSTRACT

Apparatus for the production of a packaged unit completely enclosed by a heat shrinkable foil where the unit is made up of a plurality of layers of items of the same general shape stacked one layer on another with a final layer being inset relative to the subjection layers forming inset spaces for receiving support members of a lifting device in the final package condition of the unit. Initially, a shrinkable foil is placed over the stack and is shrunk onto it. Next, the stack is inverted so that the final layer is located at the bottom. The apparatus reduces the space requirement for producing the packaged unit with the stack being moved as little as possible and increasing production output. The tool for shaping the foil on the stack are combined with at least one of the foil applying unit and a frame of the shrinkage unit and with the conveying device for the stack.

8 Claims, 5 Drawing Sheets

APPARATUS FOR PRODUCTION OF A HEAT SHRINKABLE FOIL ENCLOSED PACKAGE UNIT

BACKGROUND OF THE INVENTION

The invention is directed to apparatus for the production of a packaged unit made up of a plurality of layers of similarly shaped items stacked one layer on another and completely enclosed by shrinkable foil. In forming the stack, the layers have a similar make-up, however, the final layer is inset from the subjacent layers on at least two opposite sides forming two parallel spaces for receiving support members of a lifting device. A first shrinkable foil is placed over the entire stack and by applying heat the foil is closely shrunk about the stack. Next, the stack is inverted through 180° so that the inset final layer is located at the bottom of the stack. A second shrinkable foil is placed over the stack and is shrunk about it by applying heat.

In a known device (DE-PS No. 27 43 562), the shaping tools are located in a turning device and are formed as a two-part relatively complicated shaping frame. Prior to the entrance of a stack along with a first heat shrinkable foil positioned on it into the frame, the stack is moved to one of two conveying surfaces of the turning device. After the arrival of the stack with its first shrinkable foil, the shaping tools are moved from above into the inset spaces of the final layer of the stack during the closing movement of the two conveying surfaces of the turning device. After the stack has been turned, the shaping frame is removed from the turning device and is conveyed along with the stack through a device for applying a second heat shrinkable foil and a second shrinking device. The shaping tools are then separated from the stack and returned to the turning device. While this known device is very favorable for forming non-deformable and stable stacks, it is, however, very expensive and requires considerable space for the overall arrangement.

Furthermore, it is known in DE-PS No. 27 60 249 to position the turning device between a device for applying a single shrinkable foil and a single shrink device where there is a small output requirement for reducing the equipment expense whereby after the first shrinkable foil has been applied, the stack merely passes through the turning device without being inverted so that the first shrinkable foil can be shrunk-on in the shrinking device. Next, the stack is returned to the turning device where it is inverted and then moved back to the shrinkable foil applying device where it is covered with a second shrinkable foil. Again, the foil enclosed stack is passed through the turning device and is conveyed into the shrinking device where the second shrinkable foil is shrunk-on. To shape the inset spaces in the stack, this known device requires two additional shaping devices, one located upstream of the shrinking device for shaping the inset spaces, if the spaces are located at the top, and one downstream of the shrinking device for shaping the inset spaces if they are located at the bottom after the stack has been inverted.

In another known apparatus, disclosed in DE-OS No. 27 02 613, it is known to move the narrower final layer located on a floor mounted conveyor against a stop on one side by lowering the stack in an appropriate region of the conveyor to assure the shaping of the bottom layer with its inset spaces and to shape the opposite side of the layer by pivoting a pressure flap into contact with the layer.

Another known apparatus for shaping the inset spaces in the bottom stack is disclosed in DE-PS No. 28 39 089. In such apparatus, after the stack leaves the shrinking furnace with the shrinkable foil hood partially drawn into the inset spaces, the stack is further moved on a conveyor to a station containing sets of rollers arranged to enter the inset spaces. The sets of rollers are used as conveyor elements, the stack is placed on a lowerable section, and the section is lowered by the dimension of the rollers and the rollers move into the inset spaces with the stack being moved downwardly to an extent such that the sets of rollers press the shrunk-on hood against the bottom layer of the stack. In U.S. Pat. No. 4,724,652, another apparatus is disclosed in which a single shrinking foil application device and a single shrinking device form a combined arrangement. Shaping tools in the form of conveyor elements are incorporated into an inverting unit adjacent the combined foil applying and shrinking units. The conveyor elements are movable into a shaping position in inset spaces of a stack by a drive unit associated with the inverting unit after the stack has been inverted. Subsequently, the stack is returned to the combined foil applying and shrinking units where a second shrinkable foil is placed over the stack. Again, the stack is returned to the inverting unit to shape the foil in the inset spaces. After the conveyor elements are removed from the inset space, the stack is moved out of the inverting unit. Such an apparatus affords a reduction in the required space and in technical resources. In certain circumstances, however, due to the location of the conveyor elements shaping the foil, it may not be possible to provide an acceptable shaping of the foil in the inset spaces because the foil has been cooled as it moves from the combined units to the inverting unit. As a result, the foil tends to stretch diagonally across the insets spaces and may be damaged by the shaping tools or conveyor elements. The effect of such condition varies dependent on the type of shrinkable foil used.

SUMMARY OF THE INVENTION

Therefore, the primary object of the present invention is to provide apparatus which reduces the amount of space required and assures accurate shaping of the foil into the inset spaces without any damage to the shrinkable foil.

In accordance with the present invention, a very accurate shaping of the inset spaces is effected in a compact arrangement of the apparatus. Accordingly, the stack remains in the shrinking unit during shaping of the inset spaces and the foil does not cool whereby it is not damaged in the shaping operation. In practice, the shrinking frame can be moved downwardly around the stack along the shrinkable foil toward the conveying path and then its direction is reversed, and as it moves upwardly, the shaping tools can be moved into the inset spaces of the final layer.

It is particularly appropriate if the foil applying unit and the shrinking frame are combined as a single unit. Such an arrangement assures an appreciable reduction in the amount of space required for the apparatus with the shaping tools incorporated into the combined unit.

Another improved feature of the present invention is the provision of additional tools of the shaping device in the upper region of the shrinking unit apparatus. Such an arrangement assures that the final stack can be shaped when the final stack is in the upper position as soon as heat has been applied by the shrinking frame. This feature is particularly essential if, initially, the final layer is located at the top of the stack so that it serves as a support surface in a packaged unit not involving pallets so that the formed inset spaces are arranged to receive the fork members of a fork lift. If the final layer is initially located at the top of the stack, the foil is shrunk-on by a shrinking hood. It is appropriate to locate the forming tools in the upper position.

Another feature of the invention is that the tools for shaping the foil in the inset spaces of the stack are known set of rollers which assure a very good shaping of the inset spaces.

It is especially appropriate if the raisable and lowerable section of the conveyor is at least one shorter and narrower than the final layer of the stack. With such an arrangement a shrinkable foil hood can be placed over the stack and covers large regions of the lower part of the stack, since the raisable and lowerable section acts only upon portions of the surface where the conveyor is located. Accordingly, the shrinking of the foil about the bottom of the stack can be effected not only in the region of the inset spaces, but it can also extend down to the surface of the final layer located at the bottom of the stack.

It is self-evident with the arrangement of the present invention that it does not matter whether a so-called palletless stack or a stack mounted on a pallet is being processed. In either instance, the covering applied to the stacks can also cover large regions at the ground level of the pallet.

To assure functioning as faultless as possible, the present invention provides that the shaping tools are moved along stationary constrained guides, in particular shaped sliding surfaces, at the position for the raising and lowering of the conveyor during the application of pressing and shaping motion. Initially, it is not important whether the raising and lowering means performs the required movement or whether the shaping tools for themselves are raisable and lowerable as this is an additional feature of the invention.

The shaping tools can be guided in a constrained manner by rollers in appropriate sliding guide tracks whether it is over the entire travel relative to the stack or only over partial travel distances.

It is appropriate to locate the sets of rollers for the shaping tools on spring-loaded arms with the arms arranged to be raised and lowered so that the shaping tools are movable two-dimensionally. With such an arrangement, it is possible to compensate for an inaccurately positioned stack without affecting the functioning of the shaping tools. Further, if shaping tools are provided in the upper region of the shrinking unit they can be moved in two dimensions.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

FIGS. 1–5 illustrate only elements of a common floor mounted conveyor F located in the region of a shrinkable foil applying device, not shown in detail, along with a shrinking device for effecting simultaneous shrinking. The essential elements of this part of the over-all apparatus include a conveyor belt B mounted on a scissors-type elevating table S, not shown in detail, and rotating rollers R located along the sides of the conveyor belt. Shaping devices P are located upstream and downstream of the conveyor belt B relative to the conveying direction, and the function of such devices is described in greater detail later with regard to FIGS. 4 and 5.

Figure 5:
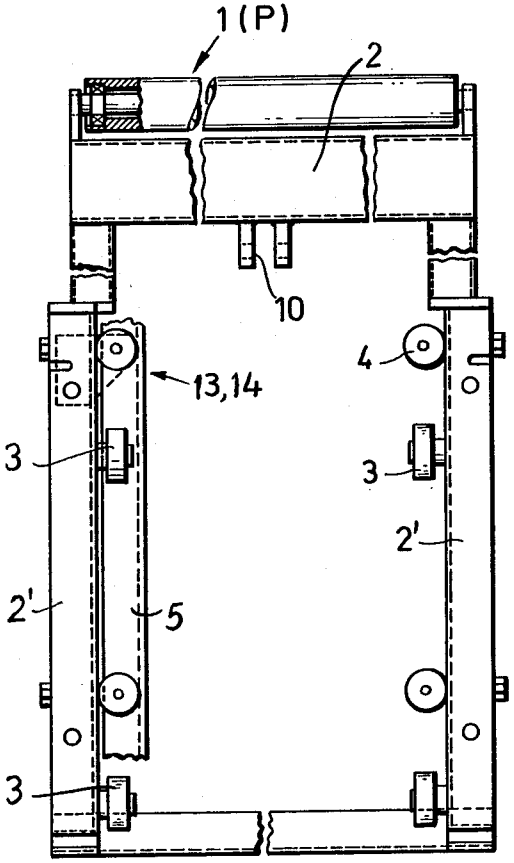
FIG. 5 is a front side view of a shaping tool.
Figure 4:
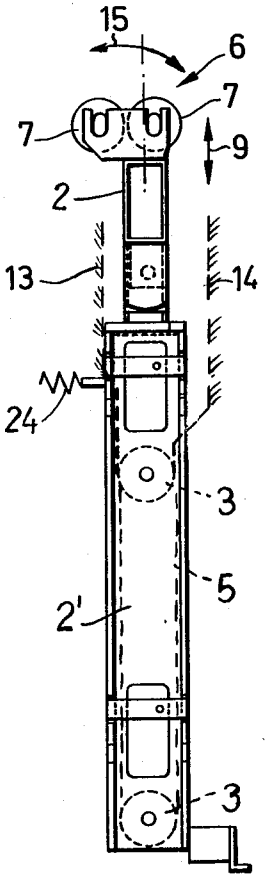
FIG. 4 is a side view of a tool of the shaping device.

Belt conveyor B is fabricated in a known manner, that is, it comprises an electric motor drive, not described in detail, belt guiding and tightening rollers and other elements. The conveyor belt B can be lifted upwardly and downwardly by a considerable amount out of the plane of the path of the conveyor F by the scissors-type elevating table S, as shown schematically in certain of the individual figures in FIG. 6. The length of the conveyor belt viewed in the conveying direction is shorter than the final layer of a packaged unit as well as being narrower so that when the final layer is placed on the conveyor, the short conveyor rollers R on the sides of the belt conveyor support the edges of the stack. In FIGS. 4 and 5, the shaping devices P are displayed and are identified by the reference numeral 1. Each shaping device 1, includes a frame 2, including upwardly extending arms 2′ with guide rollers 3, 4 co-acting with flanges and webs of generally channel shaped members 5, note FIG. 5. Each shaping device has a set of rollers 6 made up of two rollers 7, as illustrated, located on the side facing the path of conveyor F.

Figure 1:
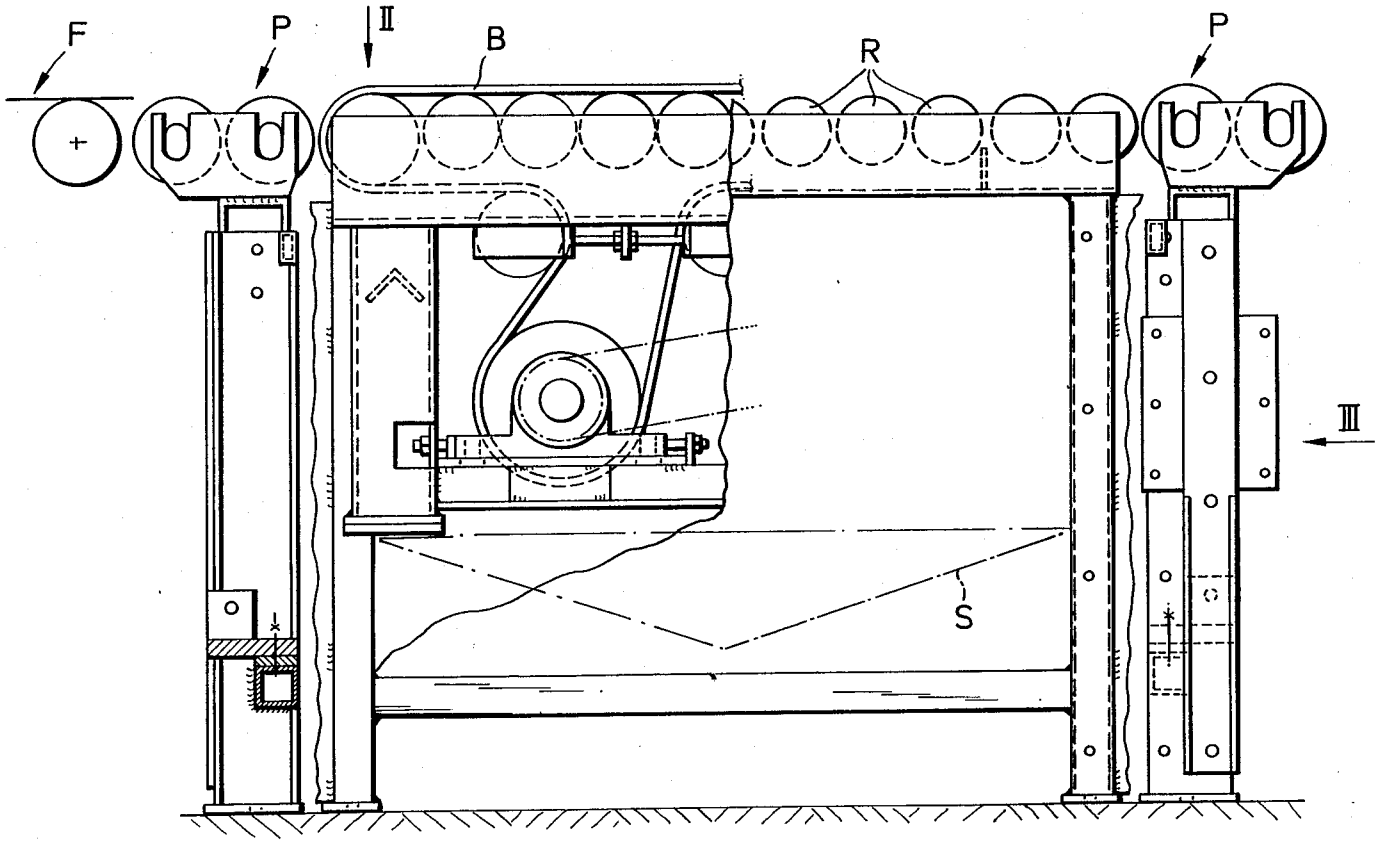
FIG. 1 is a side view of apparatus, shown partly in section, embodying the present invention.
Figure 2:
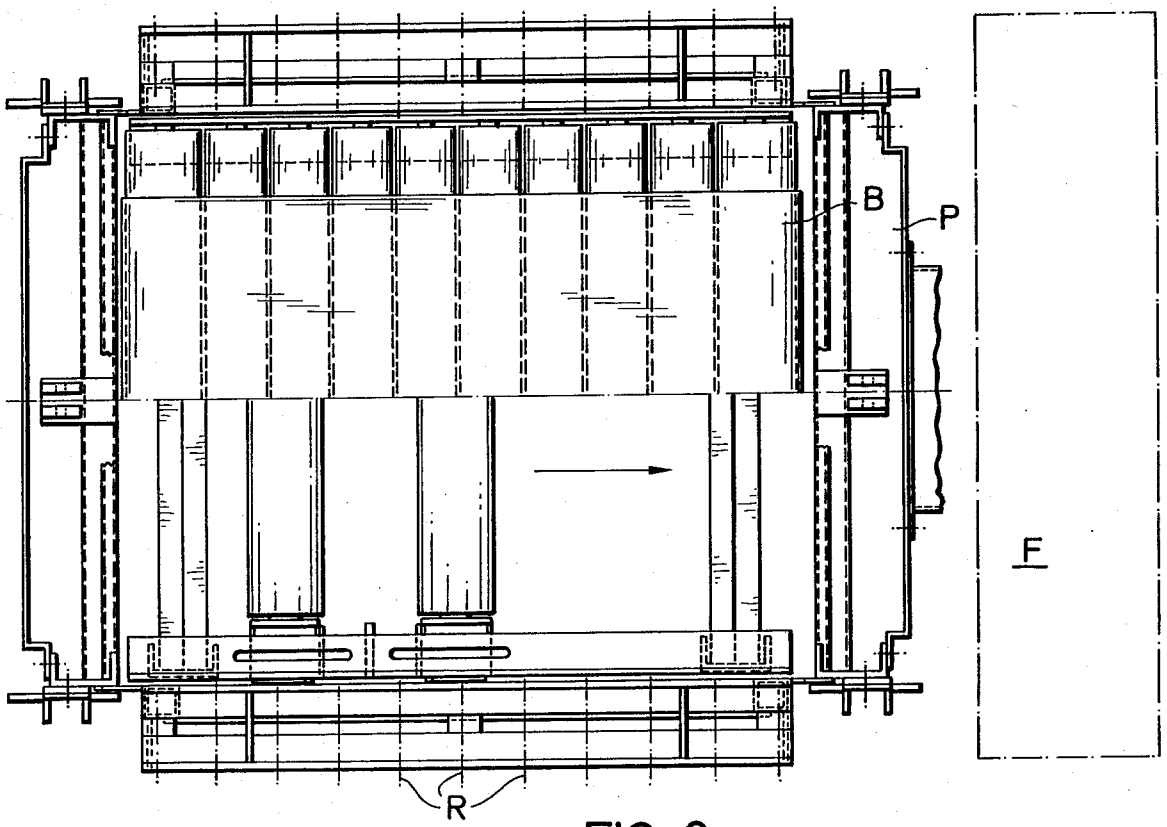
FIG. 2 is a plan view taken in the direction of the arrow II, in FIG. 1.
Figure 3:
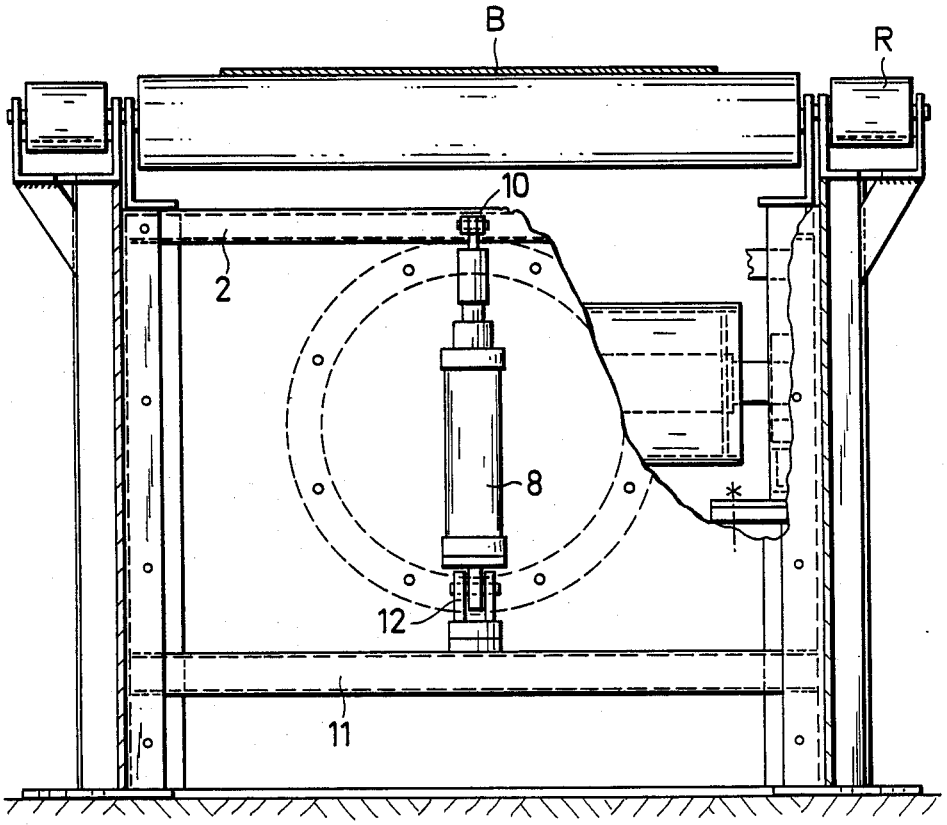
FIG. 3 is an elevational view of one side of the apparatus taken in the direction of the arrow III in FIG. 1.

Each frame 2 can be raised and lowered by a reciprocating piston, note FIG. 3, as indicated by the double headed arrow 9 in the upper part of FIG. 4. The articulation point of the piston 8 is indicated by reference numeral 10, in FIG. 5. A lower stationery articulation point for the piston is identified by the reference numeral 12 and is supported on a transverse bar 11, note FIG. 3.

A controlled guidance of the shaping device 1 is afforded, in accordance with the present invention, by shaped sliding surfaces 13, 14 at the upper parts of the members 5 as indicated schematically in broken lines in FIG. 4. The sliding surface 14 affords a more pronounced outward swiveling movement and is located on the side facing the conveyor belt B, while the opposite sliding surface 13 affording lesser movement or widening of the angle of the arms 2′, is located on the side facing away from the conveyor belt B.

Accordingly, it is evident that the shaping rollers can perform a swiveling motion as shown by a double headed arrow 15 at the top of FIG. 4. Further, the arrow is positioned to show the different swiveling travel of the rollers.

Figure 6:
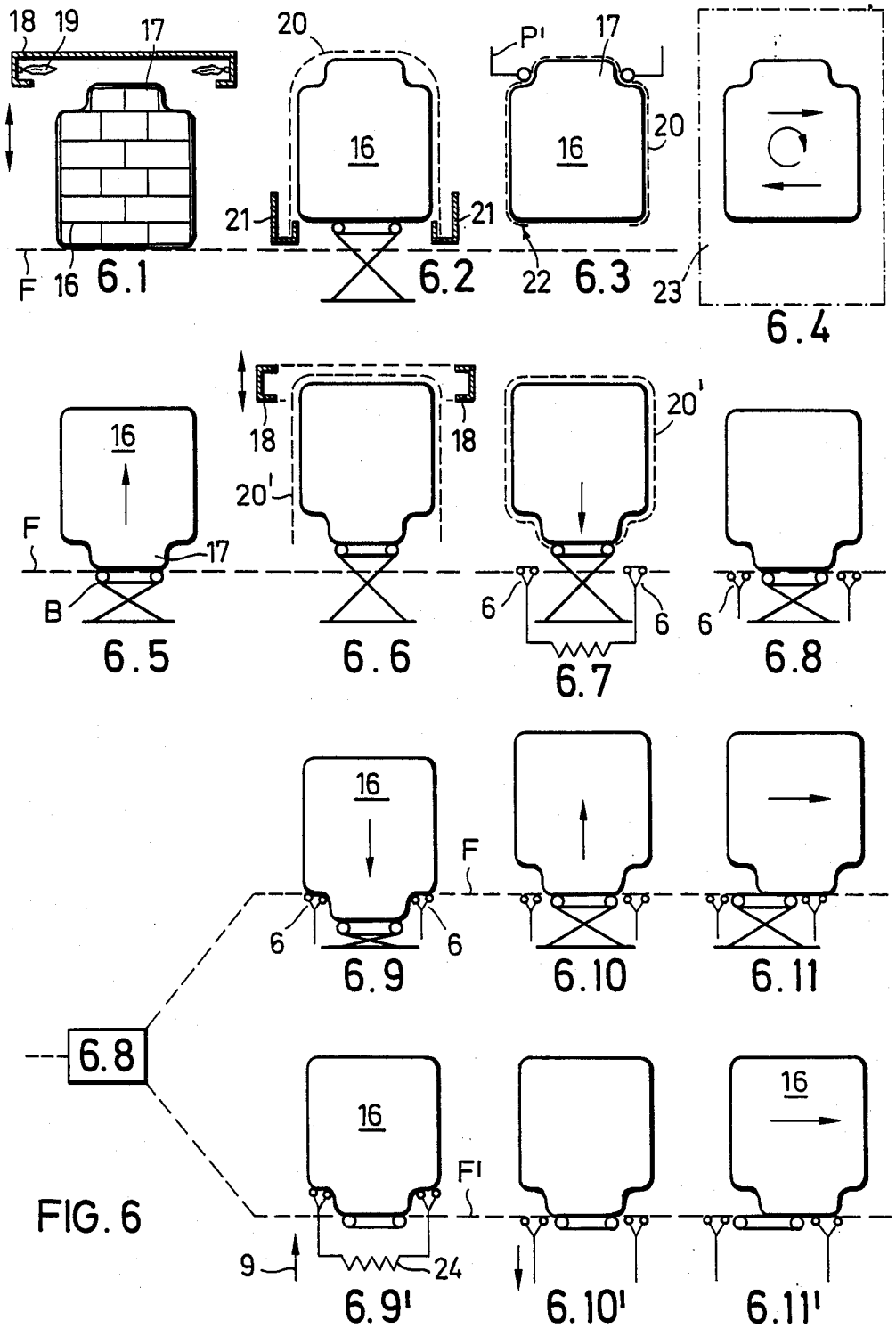
FIG. 6 is a series of individual FIGS. 6.1–6.8 illustrating schematically the various working operations of the apparatus of the present invention with two different embodiments following the operation in FIG. 6.8, that is, FIGS. 6.9–6.11 or 6.9′–6.11′.

The functional operation of the apparatus embodying the present invention is now described in greater detail with the aid of the individual figures in FIG. 6. To the extent that reference characters have been used for designating the individual parts, such designation will be maintained in the description of the functional operation sequence afforded in FIG. 6.

In FIG. 6.1, a shaped stack 16 with an inset final layer 17, located on top of the stack, includes items or containers, all of a similar shape. A shrinking frame 18 encloses the stack 16 and heat applying flames 19 are shown schematically, however, the type of heating means is not important. The stack is shown supported on the conveyor F. In FIG. 6.2, the stack 16 is in a raised position on the belt conveyor B supported on the elevating table S. The stack 16 is covered by a first shrinkable foil hood 20 and a shrinkable foil applying device 21 is displayed schematically. In the elevated position, the foil applying device 21 is moved and the shrinking frame 18 is lowered and applies heat to the foil so that a lower portion 22 of the foil hood 20 shrinks beneath the bottom of the stack 16, note FIG. 6.3. It should be noted that the shrinking frame 18 and the shrinkable foil applying device 21 can be designed as components of a common a so-called combination arrangement.

FIG. 6.3 illustrates that after the application of heat to the entire shrinkable foil, a shaping device P' is arranged for pressing the still warm shrunk-on foil hood into the corners defined by the inset final layer 17 and the subjacent layer of the stack 16.

In FIG. 6.4, the stack 16 is shown closed in broken lines by a turning or inverting device 23. The particular construction of the turning device is not important. As can be seen from a comparison of FIGS. 6.4 and 6.5, in the turning device 23, the stack is inverted, note the arrows in FIG. 6.4. In FIG. 6.5, the stack 16 has been inverted so that the final layer 17 is now located at the bottom of the stack supported on the conveyor belt B.

After the leaving the turning device 23, with the inset final layer 17 located at the bottom of the stack 16, and resting on the conveyor belt B, the belt is lifted upwardly from the position flush with the conveyor F, into the position shown in FIG. 6.6. A second shrinkable foil hood 20' is placed downwardly over the stack 16 by the shrinkable foil applying device 21, not shown in detail and the shrinking frame 18 moves downwardly, and then begins applying heat from the bottom to the top until the second hood is shrunk, as shown in FIG. 6.7. FIG. 6.8 displays the stack 16 lowered into the plane of the conveyor F.

The continuation of the process can be carried out generally in two different ways, that is, the embodiment set forth in FIGS. 6.9–6.11 or the embodiment displayed in FIGS. 6.9'–6.11'. As one alternative illustrated in FIGS. 6.9'–6.11', the stack 16 can remain in the plane of the conveyor F', and the sets of rollers 6 can be elevated in the direction of the arrow, note FIG. 6.9', for shaping the corners of the inset final layer, whereby the stack is in position to leave the apparatus. Note FIG. 6.10' where the rollers have been returned downwardly below the plane of the conveyor F' and FIG. 6.11' where the stack 16 is being moved off the belt conveyor B.

Due to the guidance afforded by the shaped sliding surfaces 13, 14 and the loading afforded by springs 24 of the arms 2' of the frame 2 carrying the shaping rollers 7, it is not only assured that the inner roller 7 molds accurately the inset spaces of the final layer 17 but also that a centering action takes place in the event the stack is not accurately positioned, so that the stack is always adjusted into a favorable position relative to the shrinking frame 18.

In the other alternative set forth in FIGS. 6.9–6.11 it can be noted that the stack 16 can be lowered from the plane of the conveyor F so that the sets of rollers 6 mold the corners of the inset spaces provided by the final layer 17. In this alternative in FIG. 6.10 the stack 16 has been returned to the plane of the conveyor F, and, as depicted in FIG. 6.11, the stack can move out of the apparatus for further processing. Moreover, the shaping devices P can be provided on the sides of the conveyor B.

While specific embodiments of the invention have been shown and described in detail to illustrate the application of the inventive principles, it will be understood that the invention may be embodied otherwise without departing from such principles.

We claim:

1. Apparatus for the production of a packaged unit including a plurality of layers of items stacked one layer on another and completely enclosed by shrinkable foil wherein in the production of the packaged unit a plurality of layers with said layers each having a plurality of items, having the same general shape, are stacked on one another with a final upper layer being inset on at least two opposite sides of the subjacent layers and forming two parallel inset spaces for receiving support members of a lifting device, a first shrinkable foil placed over the stack and by applying heat the foil is closely shrunk onto the stack, the stack with the shrunk-on foil is inverted through 180° so that the inset final layer is located at the bottom of the stack, next a second shrinkable foil is placed over the stack and is shrunk on the stack by applying heat, and at least one of prior to and after inverting the stack and shrinking of the second foil, the foils are molded into the inset spaces of the final layer wherein said apparatus includes a shrinkable foil applying unit, a foil shrinking unit, an inverting unit and a shaping means for shaping the foil into the inset spaces of the final layer, means for conveying the stack in a generally horizontal direction, said shaping means includes first shaping tools incorporated in said foil shrinking unit, and said foil shrinking unit includes a shrinking frame movable upwardly and downwardly relative to said means for conveying the stack about and in the range of the upward dimension of the stack on said conveying means, wherein said conveying means comprises a belt conveyor located in the region of said foil shrinking unit and said first shaping tools of said shaping means are located in the region of said belt conveyor.

2. Apparatus, as set forth in claim 1, wherein said shrinking frame and said foil applying unit are formed as a combined unit.

3. Apparatus, as set forth in claim 1 or 2, wherein said shaping means includes second shaping tools located in an upper region of said foil shrinking unit spaced upwardly from said first shaping tools.

4. Apparatus, as set forth in claim 3, wherein said first and second shaping tools comprise sets of rollers movable into the inset spaces in said final layer of said stack.

5. Apparatus, as set forth in claim 3, wherein said belt conveyor is displaceable in the upward and downwardly direction, said conveying means has a conveying direction and said belt conveyor is at least one of shorter than said final layer in a conveying direction of said belt conveyor than said final layer and narrower in the direction transversely of the conveying direction than the final layer.

6. Apparatus, as set forth in claim 1, wherein upwardly extending stationary constrained guides are provided for said first shaping tools, means for moving said arm upwardly and downwardly, said constrained guides include shaped sliding surfaces extending in the upward direction for contacting said shaping tools as said shaping tools are moved upwardly and downwardly.

7. Apparatus, as set forth in claim 6, wherein said belt conveyor has an upstream end and a downstream end and said constrained guides are located at the upstream and downstream ends of said belt conveyor.

8. Apparatus, as set forth in claim 6, wherein said first shaping tools comprise sets of rollers located on spring loaded arms for movement into the inset spaces in the final layer of the stack.

* * * * *